United States Patent [19]

Smith

[11] 4,075,922

[45] Feb. 28, 1978

[54] DECORATIVE PERCUSSION RHYTHM INSTRUMENT AND NOISEMAKER

[76] Inventor: Thomas R. Smith, 27 Brushy Hill Road, Newtown, Conn. 06470

[21] Appl. No.: 640,957

[22] Filed: Dec. 15, 1975

[51] Int. Cl.[2] ..... G10D 13/08

[52] U.S. Cl. ..... 84/402; 46/191

[58] Field of Search ..... 84/402, 408; 46/189, 46/191

[56] References Cited

U.S. PATENT DOCUMENTS

| | | | |
|---|---|---|---|
| 1,890,288 | 12/1932 | Graf | 46/191 |
| 3,059,375 | 10/1962 | Tischer | 84/402 X |
| 3,909,977 | 10/1975 | Kirk | 46/191 |

FOREIGN PATENT DOCUMENTS

| | | | |
|---|---|---|---|
| 3,801 | 4/1901 | Austria | 84/402 |

*Primary Examiner*—Lawrence R. Franklin

[57] ABSTRACT

A multiple bladed clapper-noisemaker is provided with a stiff central blade and adjacent thinner blades of flexible sheet material whose lower ends are held in closely juxtaposed stacked relationship by the user and whose upper ends are free to flex and bend as the user imparts flapping movement to the device. The flexible outer blades rhythmically swing away from the stiff central "drum" blade and swing back to strike it briskly with a sharp impact. The multiple impacts of the plurality of flexible blades are employed by the user to create a wide variety of different sounds, ranging from soft brushing or rattling sounds to louder multiple clapping sounds of all varieties. When the handle portions are secured together by a single grommet fastener, the multiple blades may be fanned out angularly to form an air displacing fan or an attractive decoration for horizontal or suspended display.

7 Claims, 6 Drawing Figures

DECORATIVE PERCUSSION RHYTHM INSTRUMENT AND NOISEMAKER

This invention relates to percussion rhythm instruments and noisemakers, particularly of the type held in one hand. More specifically, the present invention relates to an easily operated rattling clapper device employing a plurality of thin, flat blades preferably formed of plastic sheet material, which are easily rustled and rattled in reciprocating clapping motion to produce a wide variety of sounds.

BACKGROUND OF THE INVENTION

In addition to conventional snare drums, tom-toms, bass drums and tympani, percussion instruments include a conventional group of noisemakers, many of which are derived from folk instruments of many cultures around the world. In addition to cymbals from the Far East, there are castanets and tambourines from Southern Europe and the Mediterranean, there are maracas from Latin America, and there are several varieties of hollow wood blocks to produce "clopping" noises.

Hissing, buzzing and zipping noises customarily require the expense of a snare drum and wire brushes, or at least a back-country American corrugated washboard. Inexpensive and easily operated, multiple-clapping noisemakers have not been available prior to the present invention.

SUMMARY OF THE INVENTION

In accordance with this invention, a relatively inexpensive assembly of juxtaposed flat, thin blades of flexible material are provided, with handle portions which may be secured together by one or more fasteners, and clapper portions extending from the user's hand. Flapping motion of the device imparts flexible reciprocatory separation and multiple impacts of these blades on each other.

Preferably these blades are all substantially the same elongated shape. A central "drum" blade may be stiffer, thicker or more rigid than the outer blades, and the outermost blades may be of intermediate thickness and transversely scored to form a hinge line at which they swing away from the central blades and back in pivoting, hinging fashion.

This clapper assembly is actuated by the operator in a wide variety of different ways. Gentle flapping motion produces a swishing, brushing sound composed of very mild impacts between the flexible blades. More brisk flapping motion creates sharper clapping sounds. The assembly may be impacted on the user's shoulder, his head or the heel of the hand, or upon an identical assembly, or upon other percussion instruments. By this means, it can be operated to produce sounds comparable to maracas, castanets or brushes on a snare drum.

Accordingly, a principal object of the present invention is to provide an inexpensive hand-held noisemaker providing a variety of different noises and sounds.

Another object of the invention is to provide a multiple blade clapper noisemaker useful as a percussion rhythm instrument to produce sounds distinguishable from those made by conventional percussion instruments.

A further object of the invention is to provide an attractive assembly of elongated clapper blades secured together at one end, which may be fanned out angularly to provide a decorative fan assembly.

Other objects of the invention will in part be obvious and will in part appear hereinafter.

The invention accordingly comprises the features of construction, combinations of elements, and arrangements of parts which will be exemplified in the construction hereinafter set forth, and the scope of the invention will be indicated in the claims.

For a fuller understanding of the nature and objects of the invention, reference should be had to the following detailed description taken in connection with the accompanying drawing in which.

GENERAL DESCRIPTION

Figure 1:
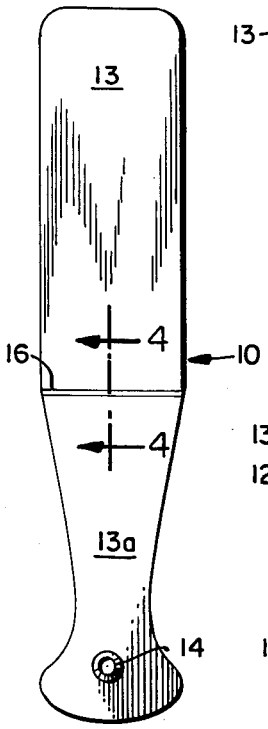
FIG. 1 is a front elevation view of a clapper assembly forming a preferred embodiment of the present invention.

In the preferred form of the clapper assembly of this invention illustrated in the drawings, the assembly 10 comprises a group of five juxtaposed clapper blades. These include a relatively thick and rigid central drum blade 11 flanked by a pair of thin, flexible clapper blades 12, which are each sandwiched between the drum blade 11 and an outer cover blade 13 of intermediate thickness, somewhat thicker than the flexible clapper blades 12, but thinner than the stiff drum blade 11. A plurality of two or more thin, flexible clapper blades 12 may be employed on each side of the device in this inter-sandwiched position, between the relatively rigid drum blade 11 and each outer flexible cover blade 13. Larger groups of assembled blades produce swishing or hissing noises, while a limited number of flexible clapper blades 12, such as the single blades sandwiched between drum blade 11 and cover blade 13 on each side of the device illustrated in the drawings, produce a sharper staccato sound.

An eyelet or grommet 14 preferably joins the juxtaposed and stacked lower ends of the assembled clapper blades which may be identified as the handle portions 11A, 12A and 13A respectively. The central opening in the eyelet 14 permits these devices to be suspended and displayed on standard merchandising wire racks, and facilitates their hanging display by the user as wall decorations.

Figure 6:
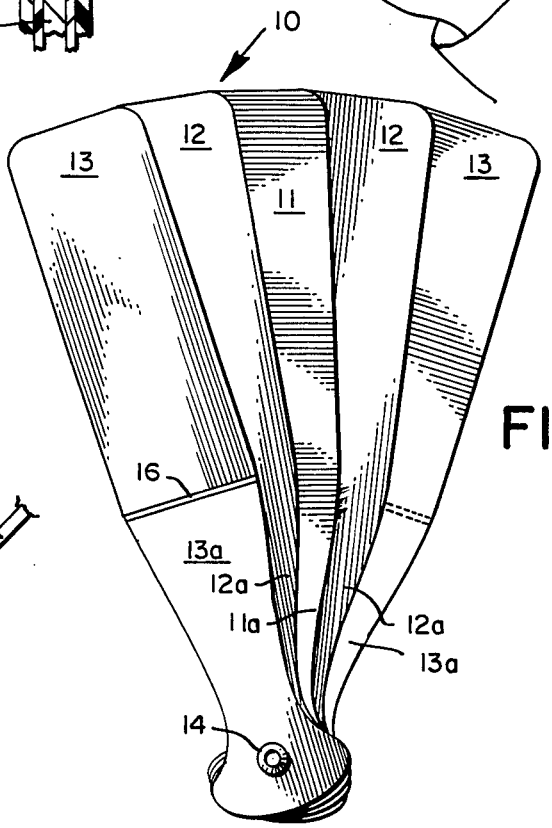
FIG. 6 is a front elevation view of the same clapper assembly, with its blades pivotally offset to form an angularly spread fan.

As illustrated in FIGS. 1 and 6, a score line 16 is impressed into the outer surface of each cover blade 13, extending transversely across its width at a central location, and serves to demark the handle portion 13A, leaving the cover clapper blade portion extending beyond the score line 16 to form the principal sound-producing portion of blade 13. Score line 16 is preferably formed closely below the midpoint of each cover blade 12 for best results. Score line 16 allows for flat hinging of outer blade 13, as compared to the flexible bending of the thinner inner blade 12, thereby producing novel sounds and timing.

As shown in FIG. 6, the assembled juxtaposed blades of the clapper device 10 may be fanned angularly apart to form an assembly comparable to an air-displacing fan and may be used by the user to fan himself. In addition, this fanclapper assembly shown in FIG. 6 makes an attractive and decorative device. The blades may be formed of different colors or of different shapes and they may be die cut with decorative outer edges forming birds, animals, or other attractive silhouettes. This juxtaposition of color and outline shapes fanned out, in the assembly shown in FIG. 6, makes an attractive decoration which may be displayed horizontally and may be suspended vertically for viewing.

Figure 2:
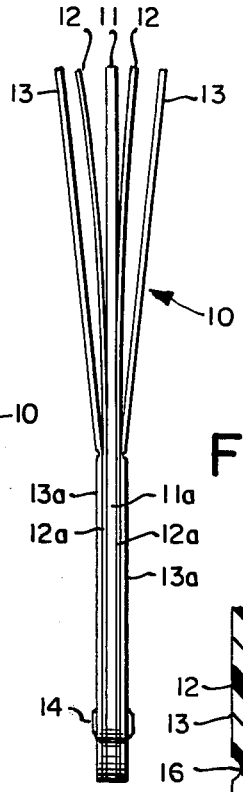
FIG. 2 is a side elevation view of the clapper assembly of FIG. 1.
Figure 4:
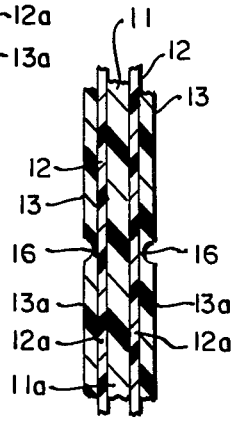
FIG. 4 is a greatly enlarged fragmentary cross-sectional elevation view, taken along the plane 4 shown in FIG. 1, illustrating the relative thickness of the different blades in the clapper assembly and the indented score line formed in each of the outermost blades.

Several different modes of sound-producing operation of the device are illustrated in the figures. In the enlarged fragmentary cross-sectional view of FIG. 4, the assembled clapper blades are all shown in their closely sandwiched juxtaposed stacked position, in which they are originally assembled and packed for shipment. In use, the clapper assembly normally appears at rest as illustrated in FIG. 2, with the outermost scored cover blades 13 slightly spread away from the inner blades.

Figure 3:
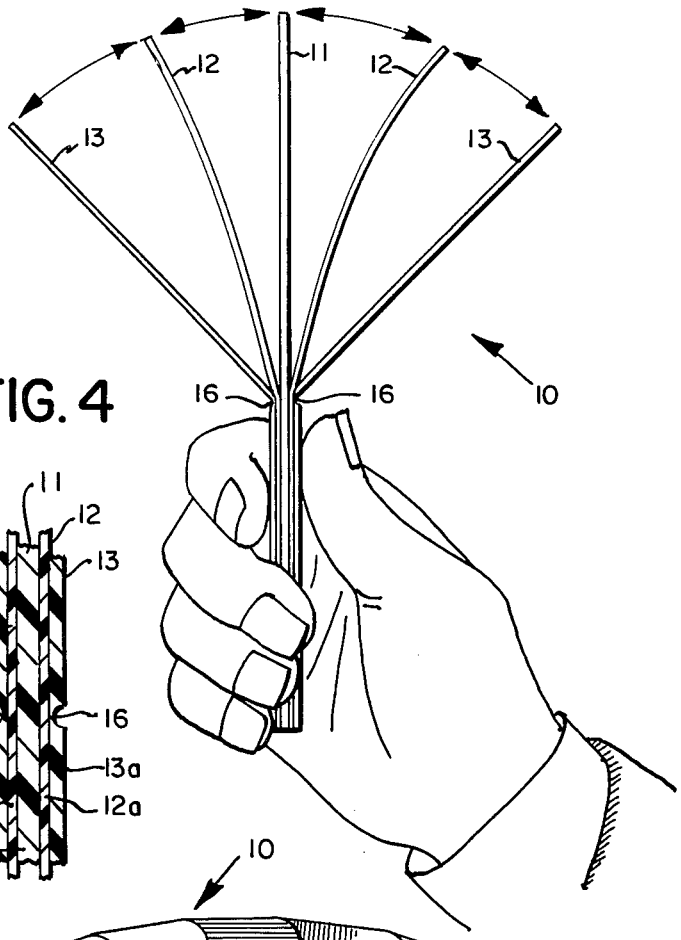
FIG. 3 is a corresponding side elevation view of the same clapper assembly showing its blades displaced through the user's vigorous flapping motion of the device.

When the user's hand 17 grips the device, tightly holding the handle portions 11A, 12A and 13A of the clapper blades in close juxtaposition throughout their length, the sound producing portions of these blades beyond the score line 16 clap briskly as the user's hand 17 imparts flapping motion to the device, as illustrated in FIG. 3, producing brisk, sharp staccato clapping reports.

Figure 5:
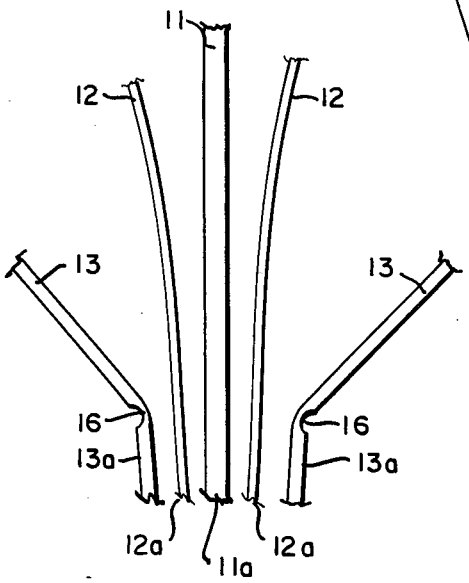
FIG. 5 is a similar enlarged cross-sectional elevation view of the same portion of the clapper assembly shown in FIG. 4, with its blades shown separated in dynamic clapping operation, showing a different operating mode from that illustrated in FIG. 3.

As the user's hand 17 grips the handle portions of the clapper blades more loosely, these may be moved in a flexible oscillating fashion, held together only by the grommet 14. In this more loosely relaxed operating mode, illustrated in FIG. 5, the handle portions of the blades are separated at their upper ends near their score lines 16 during a large part of the sound producing operating cycle of each flapping movement. As a result, the clapping sound produced by the device is less staccato and slower, and more relaxed clapping rhythms may be achieved in this manner.

When one of the outer cover blades 13 is impacted on the user's opposite hand or on any other object, the rustling or flapping motion of the assembly is sharply arrested, and the clapping sound of the device is thus punctuated by pauses of silence.

The clapper blades of this invention are preferably formed of thin, light-weight and durable plastic material, such as a "polyallomer" or mixture of polyethylene and polypropylene, providing long-lived "living hinge" operation at score lines 16. The following thicknesses have been found suitable for the three different weights of blades:

| | Standard Weight | Heavy Weight |
|---|---|---|
| Drum blades 11 | 0.100" | 0.120" |
| Clapper blades 12 | 0.023" | 0.035" |
| Cover blades 13 | 0.055" | 0.075" |

An additional advantage of the clapper assembly of the present invention is the availability of the outer surfaces of the cover clapping blades 13 to carry imprinted decorative indicia or advertising messages if desired, making these assemblies attractive and useful as advertising give-aways and premiums.

The clapper assemblies of the present invention thus provide a unique and attractive hand-held device forming a decorative appearance both in their fanned condition and in their closely stacked unfanned condition shown in FIG. 1. These assemblies may be employed by the user to achieve a wide variety of percussion sounds and rhythm noises, from gentle hissing and buzzing sounds to a noise resembling the vigorous applause of a large human audience. They may be employed in classical and popular music and in folk music of all kinds, as party noisemakers, as children's toys and as attention-getting sounding devices in sports stadiums. Between uses, they may be fanned and displayed by the user as an attractive decoration.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A sound-producing clapper assembly capable of producing a soft pattering sound and an alternative, louder, rattling drum-roll noise comprising:

A. at least one elongated drum blade formed of relatively stiff, flat material;

B. at least one flexible elongated cover blade formed of flat material thinner than that of the drum blade and having a reduced thickness bendable transverse region at an intermediate point along its length;

C. and at least one flexible elongated clapper blade formed of flat material thinner than that of the cover blade; and sandwiched between the cover blade and the drum blade;

D. with all of the elongated blades being firmly joined together at one handle end by at least one through-fastener, permitting the clapper assembly to be held in one hand by a user near the fastener and moved in a flapping motion, producing repeated successive impacts of the blades on each other, whereby gentle flapping motion patters the clapper blade softly against the drum blade, while vigorous flapping motion clatters the clapper blade briskly against both the drum blade and the cover blade in a continuous drum-roll rattle.

2. The clapper assembly defined in claim 1, wherein each of the blades is formed of a mixture of polyethylene and polypropylene.

3. The clapper assembly defined in claim 1 including one central drum blade flanked on each side by a clapper blade and a cover blade.

4. The clapper assembly defined in claim 1, including at least two clapper blades each sandwiched between a central drum blade and an outer cover blade.

5. The clapper assembly defined in claim 1, wherein the fastener is an eyelet.

6. The clapper assembly defined in claim 1, wherein one surface of the cover blade at the reduced thickness bendable transverse region is grooved to form an indented score line at which the cover blade bends.

7. The clapper assembly defined in claim 6, wherein the score line extends across the width of the elongated cover blade between its midpoint and the handle end thereof.

* * * * *